United States Patent [19]

Piera et al.

[11] Patent Number: 4,865,527

[45] Date of Patent: Sep. 12, 1989

[54] LUBRICATION OF SEALED COMPRESSORS

[76] Inventors: Daniel A. Piera; Juan J. A. Gomez, both of C. Ivorra, 16-18, Barcelona, Spain

[21] Appl. No.: 922,472

[22] Filed: Oct. 23, 1986

[30] Foreign Application Priority Data

Dec. 26, 1985 [ES] Spain ..... 550415

[51] Int. Cl.[4] ..... F04B 39/02

[52] U.S. Cl. ..... 417/368; 417/902; 184/6.16

[58] Field of Search ..... 417/368, 902; 184/6.16, 184/6.18; 418/88, 94; 415/73, 88, 91, 175

[56] References Cited

U.S. PATENT DOCUMENTS

| | | | |
|---|---|---|---|
| 2,930,522 | 3/1960 | Reichard | 184/6.16 |
| 4,456,437 | 6/1984 | Kurahayashi et al. | 417/368 |
| 4,478,559 | 10/1984 | Andrione et al. | 417/368 |
| 4,568,256 | 2/1986 | Blain | 418/94 X |

FOREIGN PATENT DOCUMENTS

| | | | |
|---|---|---|---|
| 0195560 | 9/1986 | European Pat. Off. | 418/94 |
| 57-181988 | 11/1982 | Japan | 418/88 |
| 58-174183 | 10/1983 | Japan | 417/366 |
| 58-192993 | 11/1983 | Japan | 418/88 |
| 60-053685 | 3/1985 | Japan | 417/902 |
| 60-159393 | 8/1985 | Japan | 418/94 |
| 61-043291 | 3/1986 | Japan | 418/88 |
| 61-055391 | 3/1986 | Japan | 418/94 |

*Primary Examiner*—Carlton R. Croyle
*Assistant Examiner*—Eugene L. Szczecina, Jr.

[57] ABSTRACT

Improved lubrication of sealed compressors having a crankshaft provided with a longitudinal interior duct and a tubular member coupled to a lower end of the interior duct and having a substantially cylindrical upper section and a substantially conical lower section adapted to be submerged in oil. An upper end of the internal lubrication duct ends in a first substantially conical section and a second substantially cylindrical section of variable contour depending upon the profile of the upper end of the crankshaft. A spring may also be situated inside of the tubular member.

7 Claims, 2 Drawing Sheets

LUBRICATION OF SEALED COMPRESSORS

BACKGROUND OF THE INVENTION

The present invention relates to improvements in the lubrication system of sealed compressors for cooling fluids.

Sealed compressors for cooling fluids are known which include a sealed casing with an alternating motor-driven compressor assembly housed in the interior thereof, the assembly including a vertical-axis crankshaft provided with a longitudinal interior lubrication duct communicating with various points on the exterior surface of the crankshaft and with an upper end of the same, eccentrically to the axis of rotation thereof. The assembly also includes a tubular device coupled to a lower end of the interior duct of the crankshaft, such tubular device having a first upper section substantially cylindrical and a second substantially conical section with an end having an orifice for the introduction of oil.

In such compressors, the oiling of the parts that are in friction is accomplished by means of the oil fluid supplied by the tubular device, which, when rotating and immersed in an oil mass, produces by centrifugal force the raising of the oil through the interior duct of the crankshaft towards the oiling points of the mechanism. Part of the oil exits out of the eccentric orifice at the upper end of the crankshaft, propelled against the interior surface of the sealed casing of the compressor.

There are various patents that disclose particular details of this oiling or lubricating system. U.S. Pat. No. 3,410,478 discloses a cylindrical tubular device joined by a conical section, as well as a wall placed in the interior of the tubular device acting as a gate, such a wall being costly to construct. U.S. Pat. No. 3,451,615 discloses a lateral outflow passage from an eccentric upper section of the interior duct of the crankshaft.

Lastly, Spanish Patent No. 504,039 discloses a channel in the extreme upper face of the crankshaft, arguing the lower cost of constructing such a channel in relation to the lateral outflow passage disclosed in the aforementioned U.S. Pat. No. 3,451,615.

It has been possible to confirm that the current solutions of tubular pumping devices lose part of their effectiveness as the compressor's operating temperature rises. Under these conditions, the fluidity of the oil mass deposited in the housing of the compressor reaches a point such that the oil mass loses velocity of rotation in relation to the velocity of rotation of the tubular device. Such device loses effectiveness as a centrifugal pump due to sliding between the interior wall of the tubular device and the layer of oil in contact with the wall.

The aforementioned interior wall that acts as a gate may, in part, solve the problem described, but it has the drawback of having a high cost of construction. Moreover, the orifice at the upper end of the crankshaft should have a certain form, so that the oil that exits therefrom has sufficient force to be propelled against the interior wall of the sealed casing of the compressor. This certain form, in the compressors that are known, entails significant difficulties in construction.

SUMMARY OF THE INVENTION

With the improvements of the invention, the noted drawbacks can be eliminated.

Accordingly, it is an object of the present invention to eliminate the drawbacks noted above with respect to the prior art.

It is also an object of the present invention to simplify the lubrication of compressors.

It is another object of the present invention to lower manufacturing cost of a lubrication system for compressors.

It is a further object of the present invention to compensate for the decrease in oil viscosity caused by a rise in temperature in the lubrication system of a compressor.

These and other objects are attained by the present invention which is directed to improvements in the lubrication system of compressors for cooling fluids. According to the present invention, the upper end of the interior lubrication duct in a crankshaft of the compressor ends in a first substantially conical section and a second substantially cylindrical section of variable contour depending upon the profile of the upper end of the crankshaft. This distinct configuration of the upper end of the lubrication duct offers the advantage of greater simplicity in construction and consequently a lower manufacturing cost, while at the same time maintaining the same efficiency as other current forms of more complicated configuration.

Advantageously, the tubular device, which is coupled to the lower end of the interior duct of the crankshaft, is provided in its interior with a spring formed by an elastic and resistant wire affixed by means of pressure and by insertion of a part of the spring in a substantially conical section of the tubular device or member submerged in oil (the tubular device comprises a first substantially cylindrical upper section and a second substantially conical lower section adapted to be inserted into oil). The part of the spring submerged in the oil acts as a paddle propelling the oil, and thereby compensating for decrease in oil viscosity caused by the temperature.

The aforementioned spring may have various forms or structures in accordance with the present invention. In one embodiment, the spring forms a closed loop which ends with a lower leg thereof extending towards the lower substantially conical portion of the tubular device or member. In a second embodiment, the spring takes the form of two arms making a substantially inverted U, and bent according to the conical profile of the tubular device. In another embodiment, the spring takes the form of two arms shaped in a U and bent according to the conical profile of the tubular device and with the free ends thereof joined at the upper portion thereof.

All the noted spring shapes may be constructed with wire having a circular or a square cross-section so as to improve the attachment thereof within the interior of the tubular device or member.

BRIEF DESCRIPTION OF THE DRAWINGS

For a fuller understanding thereof, the present invention will be described in greater detail below with reference to the accompanying drawings in which certain embodiments of the present invention are schematically illustrated and to which the present invention is not intended to be exclusively restricted.

In the drawings.

DESCRIPTION OF THE PREFERRED EMBODIMENTS

Figure 1:
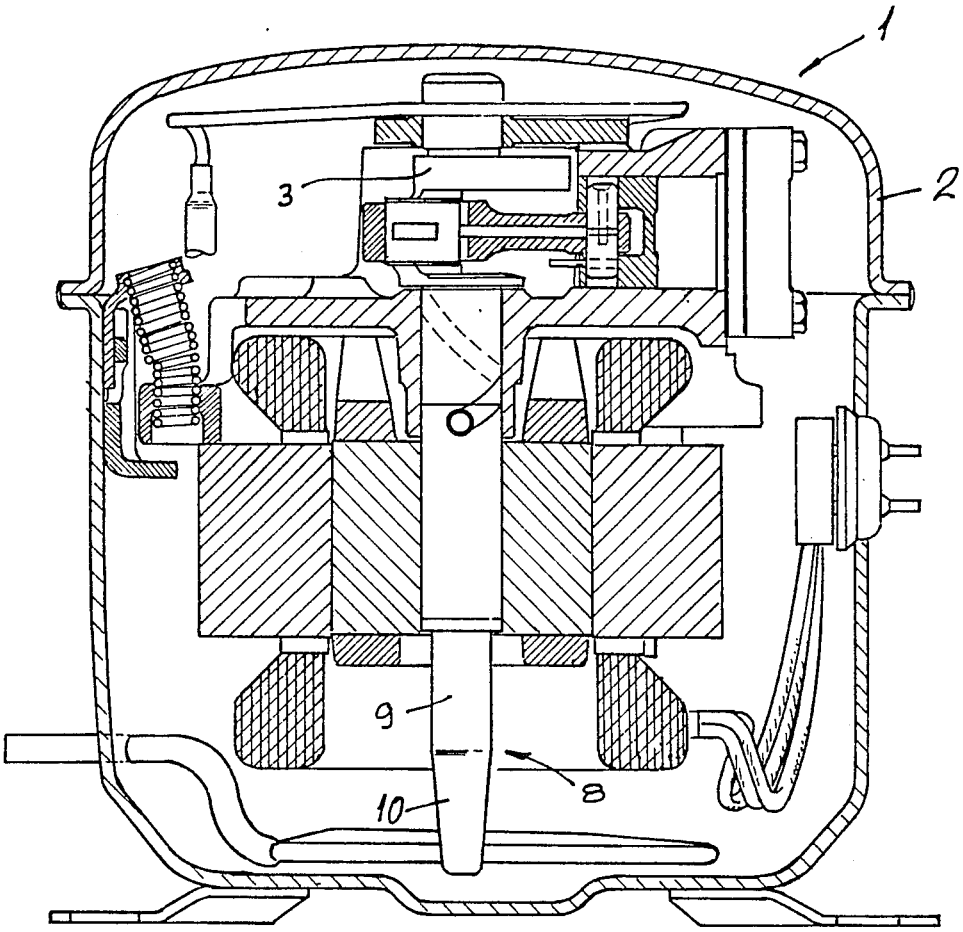
FIG. 1 illustrates a longitudinal sectional view of a sealed compressor of cooling fluids, in which the improvements according to the present invention are applied.

Referring to FIG. 1, a compressor 1 includes a sealed casing 2 with an alternating motor-driven compressor assembly housed in the interior thereof, the assembly including a vertical-axis crankshaft 3 provided with a longitudinal interior lubrication duct 4 (FIG. 2) communicating with various points 5,6 on the exterior surface of the crankshaft 3, and with the upper end 7 of the same, eccentrically to the axis of rotation thereof. The assembly also includes a tubular device 8 coupled to a lower end of the interior duct 4 of the crankshaft 3, the tubular device 8 comprising a first upper section 9 that is substantially cylindrical and a second lower substantially conical section 10 to be submerged in oil.

Figure 2:
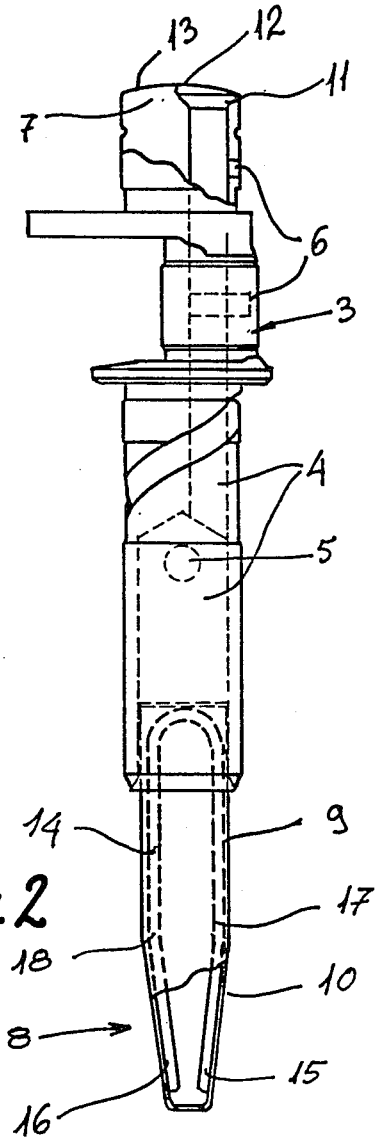
FIG. 2 is a partially sectional side view of a crank shaft and of a tubular device having the improvements according to the present invention.

As can be seen in FIG. 2, the upper end 7 of the lubrication duct 4 terminates in a first substantially conical section 11 and a second substantially cylindrical section 12 of variable contour depending upon the profile 13 of the upper end 7 of the crankshaft 3.

As also illustrated in FIG. 2, the tubular device 8 is provided in the interior with a spring 14 formed by an elastic and resistant wire, e.g. of tempered steel, and affixed by means of pressure and by insertion of part of the spring in the conical section 10 of the tubular device or member 8 which is adapted to be submerged in the oil. As shown in FIG. 2, the spring 14 takes the form of two arms 15 and 16 shaped into an inverted U and bent at points 17 and 18 according to the conical profile of the tubular device or member 8.

Figure 3:
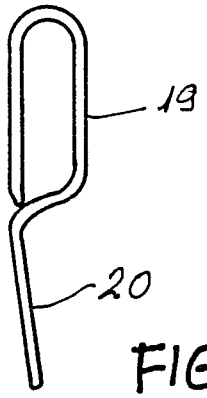

In FIG. 3, the spring 14 forms a closed loop 19 ending with a lower leg 20 thereof extending towards the lower conical part 10 of the tubular device 8.

Figure 4:
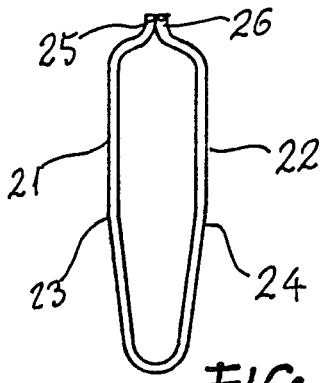
FIGS. 3 and 4 each illustrate springs for the tubular device illustrated in FIG. 2.

The spring illustrated in FIG. 4 takes the form of two arms 21 and 22 in the shape of a U bent at points 23 and 24 according to the conical profile of the tubular device 8 (i.e. the lower substantially conical section 10 thereof) and with the free ends 25 and 26 thereof joined at the upper portion as illustrated.

As described above, the springs are introduced into the tubular device 8 with the lower portion thereof situated in the conical section 10 to be submerged in oil. When the crankshaft 3 rotates, driven by the rotor of the electrical motor, the tubular device 8 rotates along with spring 14, with the lower part of the spring submerged in oil acting as a paddle.

The characteristic form 11 of the outflow orifice in the upper end 7 of the lubrication duct 4 permits the oil that flows through the eccentric duct 4 to be propelled in a continuous jet against the interior wall of the casing 2.

It follows from the description above that the improvements according to the present invention allow for enhancement in the lubrication of the crankshaft and in the propulsion of oil against the interior wall of the casing 2 due to the springs 14 acting as paddles, and allows for a reduction in the cost of manufacture of the crankshaft 3 by simplifying the orifice at the upper end 7 of the crankshaft 3 without diminishing the effectiveness thereof. Similarly, the cost of construction of the spring 14 is much lower than the previously described interior wall with respect to the prior art.

The preceding description of the present invention is merely exemplary, and is not intended to limit the scope thereof in any way.

What is claimed is:

1. In a sealed compressor including a sealed casing in which an alternating motor-driven compressor assembly is housed, the assembly including a vertical-axis crankshaft provided with a longitudinal interior lubrication duct communicating with points on an exterior surface of the crankshaft and with an upper end of the same eccentrically to the axis of rotation thereof, said assembly also including a tubular member coupled to a lower end of said interior duct of the crankshaft and comprising a substantially cylindrical upper section and a substantially conical lower section adapted to be submerged in oil, the improvement comprising an upper end of said interior lubrication duct ending in a first substantially conical section and a second substantially cylindrical section of variable contour depending upon a profile of the upper end of the crankshaft, and the profile of the upper end of the crankshaft cutting the duct at a transition point between the second substantially cylindrical section of variable contour and the first substantially conical section.

2. In a sealed compressor including a sealed casing in which an alternating motor-driven compressor assembly is housed, the assembly including a vertical-axis crankshaft provided with a longitudinal interior lubrication duct communicating with points on an exterior surface of the crankshaft and with an upper end of the same eccentrically to the axis of rotation thereof, said assembly also including a tubular member coupled to a lower end of said interior duct of the crankshaft and comprising a substantially cylindrical upper section and a substantially conical lower section adapted to be submerged in oil, the improvement comprising an upper end of said interior lubrication duct ending in a first substantially conical section and a second substantially cylindrical section of a variable contour depending upon a profile of the upper end of the crankshaft, a spring situated inside said tubular member, wherein said spring is constituted by an elastic and resistant wire formed as a closed loop ending with a lower leg extending towards the lower substantially conical portion of the tubular member.

3. In a sealed compressor including a sealed casing in which an alternating motor-driven compressor assembly is housed, the assembly including a vertical-axis crankshaft provided with a longitudinal interior lubrication duct communicating with points on a exterior surface of the crankshaft and with an upper end of the same eccentrically to the axis of rotation thereof, said assembly also including a tubular member coupled to a lower end of said interior duct of the crankshaft and comprising a substantially cylindrical upper section and a substantially conical lower section adapted to be submerged in oil, the improvement comprising an upper end of said interior lubrication duct ending in a first substantially conical section and a second substantially cylindrical section of variable contour depending upon a profile of the upper end of the crankshaft, a spring situated inside said tubular member, wherein said spring is constituted by an elastic and resistant wire shaped as a substantially inverted U with two arms and bent according to a profile of the lower conical section of the tubular member.

4. In a sealed compressor including a sealed casing in which an alternating motor-driven compressor assembly is housed, the assembly including a vertical-axis crankshaft provided with a longitudinal interior lubrication duct communicating with points on an exterior surface of the crankshaft and with an upper end of the same eccentrically to the axis of rotation thereof, said assembly also including a tubular member coupled to a lower end of said interior duct of the crankshaft and comprising a substantially cylindrical upper section and a substantially conical lower section adapted to be submerged in oil, the improvement comprising an upper end of said interior lubrication duct ending in a first substantially conical section and a second substantially cylindrical section of variable contour depending upon a profile of the upper end of the crankshaft, and a spring situated inside said tubular member, wherein said spring is constituted by an elastic and resistant wire shaped substantially as a U with upper free ends joined together and a lower end shaped according to a profile of the lower conical section of the tubular member.

5. In a sealed compressor including a sealed casing in which an alternating motor-driven compressor assembly is housed, the assembly including a vertical-axis crankshaft provided with a longitudinal interior lubrication duct communicating with points on an exterior surface of the crankshaft and with an upper end of the same eccentrically to the axis of rotation thereof, the assembly also including a tubular member coupled to a lower end of the interior duct of the crankshaft and comprising a substantially cylindrical upper section and a substantially conical lower section adapted to be submerged in oil, the improvement comprising a spring situated inside said tubular member, wherein said spring is constituted by an elastic and resistant wire formed as a closed loop ending with a lower leg extending towards the lower substantially conical portion of the tubular member.

6. In a sealed compressor including a sealed casing in which an alternating motor-drive compressor assembly is housed, the assembly including a vertical-axis crankshaft provided with a longitudinal interior lubrication duct communicating with points on an exterior surface of the crankshaft and with an upper end of the same eccentrically to the axis of rotation thereof, the assembly also including a tubular member coupled to a lower end of the interior duct of the crankshaft and comprising a substantially cylindrical upper section and a substantially conical lower section adapted to be submerged in oil, the improvement comprising a spring situated inside said tubular member, wherein said spring is constituted by an elastic and resistant wire shaped as a substantially inverted U with two arms bent according to a profile of the lower conical section of the tubular member.

7. In a sealed compressor including a sealed casing in which an alternating motor-driven compressor assembly is housed, the assembly including a vertical-axis crankshaft provided with a longitudinal interior lubrication duct communicating with points on an exterior surface of the crankshaft and with an upper end of the same eccentrically to the axis of rotation thereof.

the assembly also including a tubular member coupled to a lower end of the interior duct of the crankshaft and comprising a substantially cylindrical upper section and a substantially conical lower section adapted to be submerged in oil, the improvement comprising a spring situated inside said tubular member, wherein said spring is constituted by an elastic and resistant wire shaped substantially as a U with upper free ends joined together and a lower end shaped according to a profile of the lower conical section of the tubular member.

* * * * *